United States Patent [19]

Zarges et al.

[11] 3,941,271

[45] Mar. 2, 1976

[54] COLLAPSIBLE RECEPTACLE

[75] Inventors: Walther Zarges, Murnau; Frank Zarges, Soecking, both of Germany

[73] Assignee: Walther Zarges, Germany

[22] Filed: Sept. 11, 1972

[21] Appl. No.: 287,792

[30] Foreign Application Priority Data

Sept. 11, 1971 Germany ..... 2145550

[52] U.S. Cl. ..... 220/6; 220/4 F; 217/13

[51] Int. Cl.[2] ..... B65D 7/26

[58] Field of Search ..... 220/4 F, 6, 7; 217/13

[56] References Cited

UNITED STATES PATENTS

| | | | |
|---|---|---|---|
| 2,801,761 | 8/1957 | Pigatti et al. | 220/7 |
| 3,266,656 | 8/1966 | Kridle | 220/4 F |
| 3,598,273 | 8/1971 | Rau | 220/4 F |

FOREIGN PATENTS OR APPLICATIONS

| | | | |
|---|---|---|---|
| 1,298,440 | 7/1969 | Germany | 220/4 F |
| 842,635 | 7/1960 | United Kingdom | 220/4 F |
| 313,778 | 8/1969 | Sweden | 310/217 |

*Primary Examiner*—William Price
*Assistant Examiner*—Joseph M. Moy
*Attorney, Agent, or Firm*—Craig & Antonelli

[57] ABSTRACT

An improvement in collapsible receptacles including the provision of respective inwardly and outwardly directed projections on the base frame and sidewalls of the receptacle. The outwardly directed projection of the sidewall overlaps the inwardly directed projection of the base frame to maintain the receptacle in the assembled non-collapsed condition such that a tilting of the sidewalls is necessary to raise the sidewall. The overlapping projection on the sidewall also serves as a water shield for the joint between the frame and sidewalls.

21 Claims, 2 Drawing Figures

COLLAPSIBLE RECEPTACLE

BACKGROUND AND SUMMARY OF THE INVENTION

The present invention relates to an improvement in collapsible receptacles of the type disclosed in U.S. application Ser. No. 184,502, filed Sept. 29, 1971, now U.S. Pat No. 3,782,579, dated Jan. 1, 1974. The disclosure of this U.S. application is hereby incorporated by reference herein to the extent necessary for a complete understanding of the present invention.

The above-mentioned application describes a collapsible receptacle with or without a lid in which the lower end of the walls is hingedly connected with the base frame via bolts introduced into holes in such a way that each hole associated with a hinge bolt is in the form of a slot-like oblong hole open at its upper end which has a greater length than the cross-sectional size of the hinge bolt and with which is associated a blocking means which prevents the removal of a hinge bolt from its oblong hole.

To ensure that the walls of such receptacles can be easily assembled and that during assembly no specific sequence need be adhered to and whereby in addition the walls can without difficulty be replaced by others without however such collapsible receptacles having loose members, the instruction is given in the above-mentioned application that the oblong holes for at least two facing walls have identical length and their ends have the same distance from the receptacle base and that the blocking means associated with each oblong hole has such a distance from the lower end of the oblong hole that displacement of the hinge bolt permits superimposition of the walls. The upper end of each oblong hole relative to the cross-sectional size of the associated hinge bolt is narrowed to a smaller opening with and this construction is removable or elastically enlargeable. The opening of each oblong hole can also be arranged in the longitudinal wall on the inside of the receptacle. It is also recommended that all oblong holes be given the same length corresponding to the sum of the wall thickness of the four walls of the receptacle. These oblong holes are in each case formed in a corner member fixed to the receptacle base frame.

It is also recommended that the frame surrounding the base of the receptacle and the walls thereof be provided with point shaped or linearly interacting stop members which engage in one another when the walls are assembled.

An object of the present invention is to so further develop the collapsible receptacles of the type disclosed in the above-mentioned application that each wall maintains itself in its position in the erected state. This problem is solved according to the invention in that on each wall an outwardly directed projection is provided which overlaps an inwardly directed projection of the base frame. These projections ensure that each wall can be moved inwardly from its erected position in the sense of a collapse of the receptacle only if the wall is raised by that amount by which the projection of the wall overlaps the projection of the base frame. Such a receptacle wall can in practice also not be forced inwards because the outwardly directed projection stiffens the wall over its complete width. Furthermore the forces acting in the plane of the erected wall via the projection are uniformly transmitted into the base frame which is important in that collapsible receptacles of this type are stacked one upon the other for example when transported in vehicles.

It is also contemplated by the present invention that each wall be provided with a further outwardly directed projection which overlaps the inwardly directed projection of the base frame. This prevents the wall being unintentionally raised relative to the base frame because through the further outwardly directed projection the wall can only be raised relative to the base frame when it is intentionally placed in an inclined position.

According to a further feature of the present invention, the outwardly directed wall projection of each wall overlapping the base frame projection should preferably be in the form of a rim which deflects water outwardly which ensures that water falling on the outside of the receptacle cannot reach the inside of the receptacle.

The invention is subsequently explained relative to two exemplified embodiments wherein are shown only the features essential for the present invention, thus for example the openings associated with each oblong hole necessary to remove the hinge bolts of the walls from the oblong holes in the base frame are not shown.

DETAILED DESCRIPTION OF THE DRAWINGS

Figure 1:
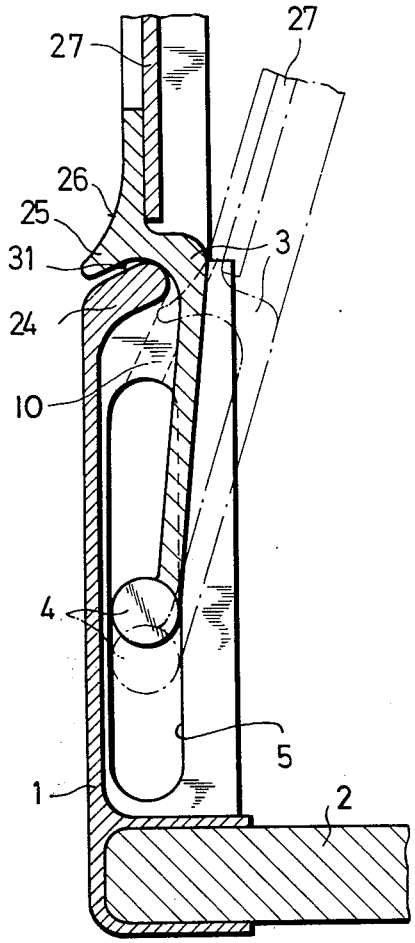
FIG. 1 is a partial cross-sectional view through the base of a collapsible receptacle with part of a wall having one outwardly directed projection.

A base frame 1 secures in place a base 2 of a collapsible receptacle. Each wall 3 associated with base frame 1 is provided at its lower end with two laterally arranged hinge bolts 4, each of which is inserted in a slot-like oblong hole 5 provided in the corners of the receptacle. Base frame 1 is provided with a peripheral inwardly directed projection 24 having a bead-like cross-section. At a distance from the hinge bolts 4 the wall 3 has an outwardly directed projection 25 which, with wall 3 erected, overlaps the inwardly directed projection 24 of base frame 1 in such a way that wall 3 can only be tilted into the receptacle inner area by raising wall 3. Therefore, if the collapsible receptacle is closed by a lid, wall 3 cannot normally be removed from the position shown by continuous lines in FIG. 1 into another position. Projection 25 merges via a curved surface 26 into the plane of wall 3. If the receptacle is initially collapsed and one of the walls 3 is raised without thereby raising hinge bolts 4 the wall strikes against projection 24 of base frame 1. On further raising of wall 3 surface 26 slides along projection 24 whereby wall 3 can automatically be easily tilted inwards as shown by broken lines in FIG. 1. On further raising the wall can again be tilted outwards and then rests on projection 24 of base frame 1. Although wall 3 may comprise a one-piece section having hinge bolts 4 it is recommended that only the lower part of the wall be in the form of a sectional member rigidly connecting therewith an upper planar wall portion 27.

Figure 2:
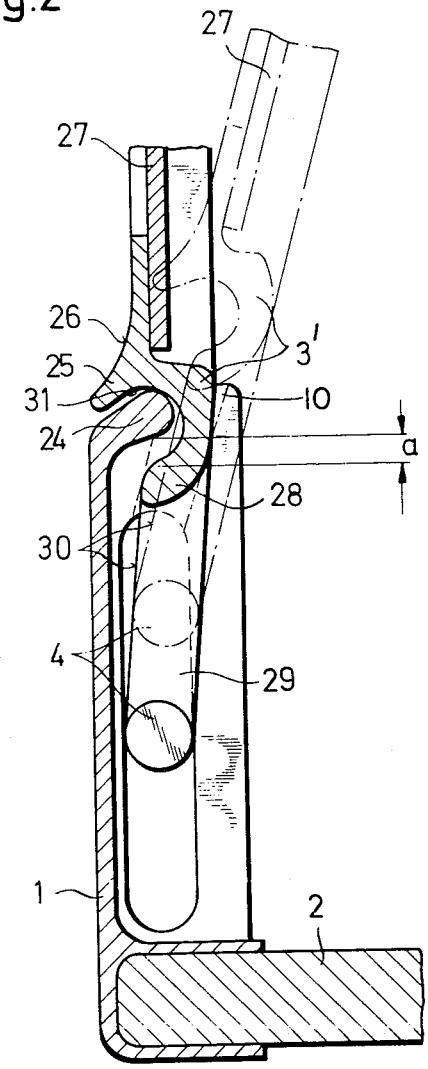
FIG. 2 is a partial cross-sectional view corresponding to FIG. 1 with a wall having two outwardly directed projections.

The embodiment shown in FIG. 2 corresponds fundamentally to the embodiment of FIG. 1 with the sole difference that each wall section has a second outwardly directed projection 28 which is connected in each case via a bracket 29 with a hinge bolt 4. Here again wall section 3′ is rigidly connected with a planar wall portion 27. If wall 3′ is erected, i.e., it extends in a substantially perpendicular plane then the outwardly directed projection 25 of wall 3′ overlaps the inwardly directed projection 24 of base frame 1. As the individual walls of the erected receptacle mutually prevent one another from tilting inwards, each wall can only be raised in a perpendicular direction and namely by an amount *a*, because then projections 28 and 24 abut against one another and prevent a further raising of the wall. If wall 3′ on erecting the wall is raised too high then the corresponding projection 24 slides along the surfaces 30 of cantilevers 29 until surface 31 of projection 25 rests on the top of projection 24. The described transition state is shown by broken lines in FIG. 2.

As can be seen from both figures each outwardly directed projection 25 of walls 3 and 3′ is in the form of a rim which directs water outwards so as to prevent entry of water into the receptacle. This is achieved in that the surfaces forming projection 25 converge on the outside at the bottom.

Element 10 schematically indicates an opening and blocking means, the details of which are disclosed in the above-noted U.S. Pat. No. 3,782,579 which has been incorporated by reference.

While we have shown and described only several preferred embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are within the scope of those skilled in the art.

We claim:

1. Collapsible receptacle comprising:

a base frame having a plurality of vertically extending oblong holes, a plurality of sidewalls having hinge bolts connected to the lower ends thereof, said hinge bolts being positioned in said oblong holes in the assembled condition of the receptacle, said oblong holes being longer than the cross-sectional size of said hinge bolts and having an opening adjacent their upper ends for introducing the hinge bolts, and blocking means for preventing the removal of the hinge bolts from the respective oblong holes during normal use of the receptacle, wherein each sidewall has a first outwardly directed projection and wherein said base frame has a plurality of inwardly directed projections corresponding in number to the number of walls, and wherein said first outwardly directed projections overlap corresponding ones of said inwardly directed projections when the receptacle is in an assembled and non-collapsed condition, said overlapping projections serving to maintain the receptacle in said non-collapsed condition.

2. A receptacle according to claim 1, wherein each sidewall has a second outwardly directed projection which engages beneath corresponding ones of said inwardly directed projections of said base frame to prevent raising of said sidewalls except in an inclined position.

3. A receptacle according to claim 1, wherein said first outwardly directed projections are constructed as water guide members for directing rainwater and the like outwards of the receptacle.

4. A receptacle according to claim 2, wherein said first outwardly directed projections are constructed as water guide members for directing rainwater and the like outwards of the receptacle.

5. A receptacle according to claim 1, wherein the oblong holes associated with two facing sidewalls of the receptacle have an identical length with their ends the same distance from a base of the receptacle, wherein said blocking means associated with each oblong hole is at such a distance from the lower end of the oblong hole that a displacement of the hinge bolt for the superimposition of the sidewalls is possible, and wherein the base frame is provided with point shaped linearly interacting stop members for maintaining the bottom edges of the sidewalls in position in the assembled and non-collapsed condition of the receptacle.

6. A receptacle according to claim 5, wherein each sidewall has a second outwardly directed projection which engages beneath corresponding ones of said inwardly directed projections of said base frame to prevent raising of said sidewalls except in an inclined position.

7. A receptacle according to claim 5, wherein said first outwardly directed projections are constructed as water guide members for directing rainwater and the like outwards of the receptacle.

8. A receptacle according to claim 6, wherein said first outwardly directed projections are constructed as water guide members for directing rainwater and the like outwards of the receptacle.

9. A receptacle according to claim 1, wherein said receptacle has means including the overlapping projections, for maintaining said receptacle in the assembled non-collapsed condition without the necessity of a lid.

10. A receptacle according to claim 9, wherein said receptacle includes provisions for accepting a lid.

11. A receptacle according to claim 1, wherein said hinge bolts are slidable along the greater dimensions of said oblong holes.

12. A collapsible receptacle comprising:

at least one base frame means, and at least one sidewall means slidably connected to said frame means between a collapsed position and an assembled position, wherein each sidewall means has a first outwardly directed projection means and a second outwardly directed projection means, said base frame means has at least one inwardly directed projection means, said outwardly directed projection means engages beneath at least a corresponding one of said inwardly directed projection means of said base frame means to prevent raising of said sidewall means except in an inclined position, said first outwardly directed projection means overlaps at least a corresponding one of said inwardly directed projection means when the receptacle is in an assembled and non-collapsed condition, said overlapping inwardly and outwardly directed projection means serving to maintain the receptacle in said non-collapsed condition.

13. A receptacle according to claim 12, wherein said first outwardly directed projection means is constructed as water guide means for directing rainwater and the like outwards of the receptacle.

14. A collapsible receptacle comprising:

at least one base frame means, and at least one sidewall means slidably connected to said base frame means between a collapsed position and an assembled position, wherein each sidewall means has at least a first outwardly directed projection means constructed as water guide means for directing rainwater and the like outwards of the receptacle and wherein said base frame means has at least one inwardly directed projection means, said at least a first outwardly directed projection means overlaps at least a corresponding one of said at least one inwardly directed projection means when the receptacle is in an assembled and non-collapsed condition, said overlapping inwardly and outwardly directed projection means serving to maintain the receptacle in said non-collapsed condition.

15. A receptacle according to claim 14, wherein said first outwardly directed projection means is constructed to ensure that water falling on the outside of the receptacle can not reach the inside of the receptacle.

16. A collapsible receptacle comprising:

at least one base frame means, and at least one sidewall means slidably connected to said base frame means between a collapsed position and an assembled position, wherein said base frame means has a plurality of oblong holes in which said sidewall means is slidably connected, each sidewall means has at least a first outwardly directed projection means and said base frame means has at least one inwardly directed projection means, said at least a first outwardly directed projection means overlaps at least a corresponding one of said at least one inwardly directed projection means when the receptacle is in an assembled and non-collapsed condition, said overlapping inwardly and outwardly directed projection means serving to maintain the receptacle in said non-collapsed condition.

17. A receptacle according to claim 16, wherein said sidewall means has hinge means connected thereto, said hinge means being positioned in said oblong holes in use to render said slidable connection between said sidewall means and said base frame means.

18. A receptacle according to claim 17, wherein said hinge means are connected to lower ends of said sidewall means.

19. A receptacle according to claim 18, wherein said base frame means has an opening therein adjacent the upper end of each oblong hole for introducing the hinge means.

20. A receptacle according to claim 19, wherein blocking means are provided at each opening for preventing the removal of the hinge means from the respective oblong holes during normal use of the receptacle.

21. A receptacle according to claim 20, wherein the hinge means are bolts.

* * * * *